US011092048B2

(12) United States Patent
Blundy

(10) Patent No.: US 11,092,048 B2
(45) Date of Patent: Aug. 17, 2021

(54) COMPLETE VOLUME DRAINING OIL PAN AND DEVICE

(71) Applicant: K.J. Manufacturing Co., Wixom, MI (US)

(72) Inventor: George Blundy, Walled Lake, MI (US)

(73) Assignee: K.J. Manufacturing Co., Wixom, MI (US)

( * ) Notice: Subject to any disclaimer, the term of this patent is extended or adjusted under 35 U.S.C. 154(b) by 0 days.

(21) Appl. No.: 16/716,426

(22) Filed: Dec. 16, 2019

(65) Prior Publication Data

US 2020/0116053 A1 Apr. 16, 2020

Related U.S. Application Data

(63) Continuation of application No. 15/354,157, filed on Nov. 17, 2016, now Pat. No. 10,508,571.

(51) Int. Cl.
*F01M 11/04* (2006.01)
*F01M 11/00* (2006.01)

(52) U.S. Cl.
CPC ..... *F01M 11/0458* (2013.01); *F01M 11/0004* (2013.01); *F01M 2011/007* (2013.01)

(58) Field of Classification Search
CPC ..... F01M 11/0458; F01M 11/0004; F01M 2011/007
See application file for complete search history.

(56) References Cited

U.S. PATENT DOCUMENTS 4,053,291 A * 10/1977 Sims ..... B01D 19/0057 96/209
4,615,314 A * 10/1986 Baugh ..... F02B 77/00 123/195 C
4,925,627 A * 5/1990 Johnson ..... B01L 3/5082 422/520
4,986,235 A * 1/1991 Ishii ..... F01M 11/0004 123/195 C (Continued)

FOREIGN PATENT DOCUMENTS

EP 0453768 A1 10/1991
EP 2265853 A2 12/2010
RU 31408 U1 8/2003

OTHER PUBLICATIONS

International Search Report, dated Feb. 28, 2018, 7 pages.
Supplementary European Search Report, PCT/US2017062241, dated Jul. 6, 2020, 7 pages.

*Primary Examiner* — Michael A Riegelman
(74) *Attorney, Agent, or Firm* — Young Basile Hanlon & MacFarlane, P.C.

(57) ABSTRACT

A drain tube device that includes a first tubular region, a second region and arcuate tubular region interposed between the first tubular region and the second region. In certain embodiments, the arcuate region is contiguously joined to the first tubular and the second region such that the first tubular region and the second region form an acute angle in a first plane that is between 45° and 90°. The second region has an end distal to the arcuate tubular region and includes a longitudinal opening defined in at least a portion of the region between the arcuate tubular region and the distal end. In certain embodiments, the arcuate region can also have a configuration that provides an angle located out of the first plane between the first tubular region and the second region that is between zero and 90°.

20 Claims, 9 Drawing Sheets

(56) References Cited

U.S. PATENT DOCUMENTS

| | | | | | |
|---|---|---|---|---|---|
| 5,377,781 | A * | 1/1995 | Yun | F04B 39/0246 | 184/6.23 |
| 5,601,060 | A * | 2/1997 | Smietanski | F01M 11/0004 | 123/195 C |
| 5,884,727 | A * | 3/1999 | Ryu | F16N 7/366 | 184/6.3 |
| 6,041,752 | A * | 3/2000 | Van Klompenburg | F01M 11/0004 | 123/195 C |
| 6,705,349 | B2 * | 3/2004 | Themudo | F01M 13/0405 | 138/89 |
| 7,021,425 | B2 * | 4/2006 | Noguchi | F04B 39/0253 | 184/6.16 |
| 8,020,665 | B2 * | 9/2011 | Sheridan | F02C 7/36 | 184/6.12 |
| 8,292,034 | B2 * | 10/2012 | Mount | F01D 25/18 | 184/6.11 |
| 8,746,407 | B2 * | 6/2014 | Rosea | F16N 7/363 | 184/6.16 |
| 8,925,581 | B2 * | 1/2015 | Pekarsky | F16L 41/086 | 137/592 |
| 2001/0050200 | A1 * | 12/2001 | Oh | F04B 39/0253 | 184/6.16 |
| 2010/0230212 | A1 * | 9/2010 | Jensen | B01D 35/027 | 184/6.24 |
| 2015/0176492 | A1 * | 6/2015 | Cutrara | F02C 7/06 | 184/106 |
| 2017/0051645 | A1 * | 2/2017 | Mistry | F04B 39/02 | |
| 2018/0073403 | A1 * | 3/2018 | Xu | F01M 11/0458 | |
| 2018/0135478 | A1 * | 5/2018 | Blundy | F01M 11/0408 | |
| 2018/0223707 | A1 * | 8/2018 | Demeulenaere | F01M 11/0004 | |

* cited by examiner

COMPLETE VOLUME DRAINING OIL PAN AND DEVICE

CROSS-REFERENCE TO RELATED APPLICATIONS

This application is a continuation of U.S. patent application Ser. No. 15/354,157, filed on Nov. 17, 2016, the entire disclosure of which is hereby incorporated by reference.

TECHNICAL FIELD

This disclosure relates to methods and devices for removing spent material from oil pans and reservoirs as well as oil pans and reservoirs so equipped.

BACKGROUND

Lubrication is necessary for efficient operation of various engines and motor devices. In various devices such as internal combustion engines, lubrication oil is recirculated through lubrication passages defined in the engine during routine engine operation. An associated reservoir such as an oil pan contains the lubrication oil between periods of engine operation and also holds excess or reserve oil during periods of engine operation.

In order to maintain the engine and ensure proper engine life, it is necessary to remove spent engine oil and replace it with fresh or reconditioned material. It is desirable that these oil change operations be accomplished in an efficient, environmentally friendly manner. In many situations this includes the use of automated oil change devices.

The effectiveness of any oil change removal operation, be it automated or manual, is dependent on effective evacuation of the oil pan during oil change operations. Solid waste, residue, and degraded oil products collect in the bottom of the oil pan. If these materials remain during evacuation, they can mix with the newly added material. This can reduce the life and effectiveness of the newly added material. In certain instances, the solid waste, residue, and degraded oil can accumulate in the oil pan over time creating an undesirable sludge that is difficult to remove.

This problem is compounded by the location of the drain plug opening in the associated oil pan. Depending on the specific architecture of the oil pan and the associated vehicle, the drain plug opening may be located in a region of a side wall of the oil pan. This oil pan architecture can make it difficult to accomplish complete effective spent oil removal, particularly in high speed automated or semi-automated oil removal/change operations. To date, no effective method or device has been proposed to achieve complete evacuation of oil pans, particularly oil pans having irregularly configured or positioned drain plug openings.

Thus, it would be desirable to provide a device, such as a drain tube, that can be used with oil pans to facilitate effective and efficient removal of spent oil from the interior of the oil pan. It is also desirable that the device be capable of facilitating reciprocal filling of the oil pan with fresh oil where desired or required.

SUMMARY

Disclosed herein is a drain tube device that includes a first tubular region, a second region and arcuate tubular region interposed between the first tubular region and the second region. In certain embodiments, the arcuate region is contiguously joined to the first tubular and the second region such that the first tubular region and the second region form an acute angle in a first plane that is between 45° and 90°. The second region has an end distal to the arcuate tubular region and includes a longitudinal opening defined in at least a portion of the region between the arcuate tubular region and the distal end. In certain embodiments, the arcuate region can also have a configuration that provides an angle located out of the first plane between the first tubular region and the second region that is between zero and 90°.

These and other aspects of the present disclosure are disclosed in the following detailed description of the embodiments, the appended claims, and the accompanying figures.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
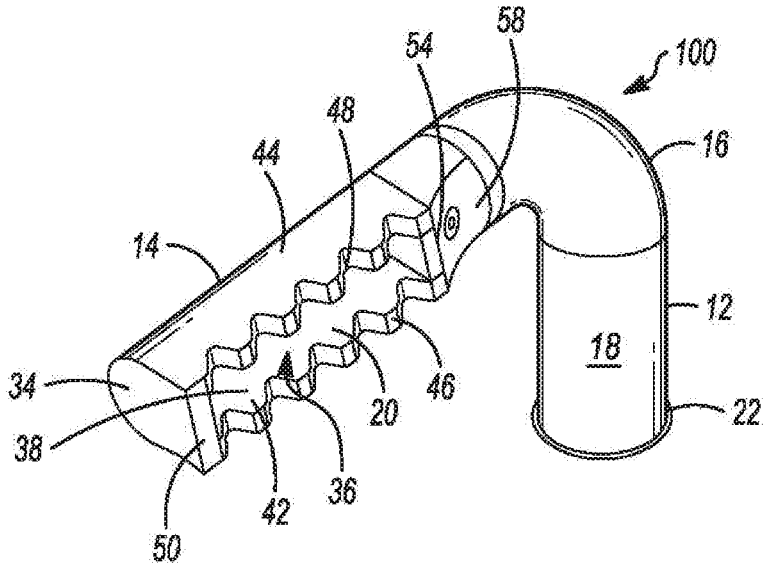
FIG. 1 is perspective view of an embodiment of a drain tube as disclosed herein.

The present disclosure is directed to a novel drain tube for use with an oil pan or other suitable oil reservoir to facilitate rapid efficient and essentially complete evacuation of oil from the interior of the oil pan to a suitable external location. The present disclosure is also directed to novel efficient draining oil pans that are configured with the drain tube disclosed herein. This disclosure is also directed to a method for effectively removing and/or replacing oil in a vehicle equipped with an internal combustion engine.

The novel drain tube 10 as disclosed herein includes a first tubular region 12, a second region 14, and arcuate tubular region 16 interposed between the first tubular region 12 and the second region 14. The arcuate tubular region 16 is contiguously joined to the first and second regions such that the first tubular region 12 and the second region 14 form an acute angle θ in a first plane that is between 45° and 90°. In certain embodiments, the acute angle θ is between 65° and 80°. The drain tube 10 is configured with an outer surface 18 and an interior surface 20.

The first tubular region 12 of the drain tube 10 as depicted in the various drawing figures can be an elongated cylindrical member having an outer end region 22 having a first face 24 distal to the arcuate tubular region 16. An interior channel is defined in the first tubular region 12 extending from an opening defined in the first face 24 of the outer end region 22 that communicates with the interior channel defined in the first tubular region 12.

Figure 6:
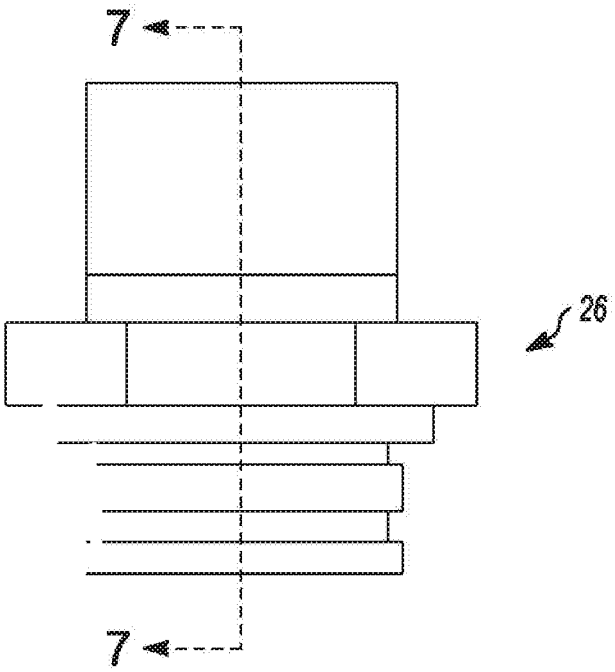
FIG. 6 is an embodiment of a quick connect connector suitable for use with the drain tube of FIG. 1.
Figure 7:
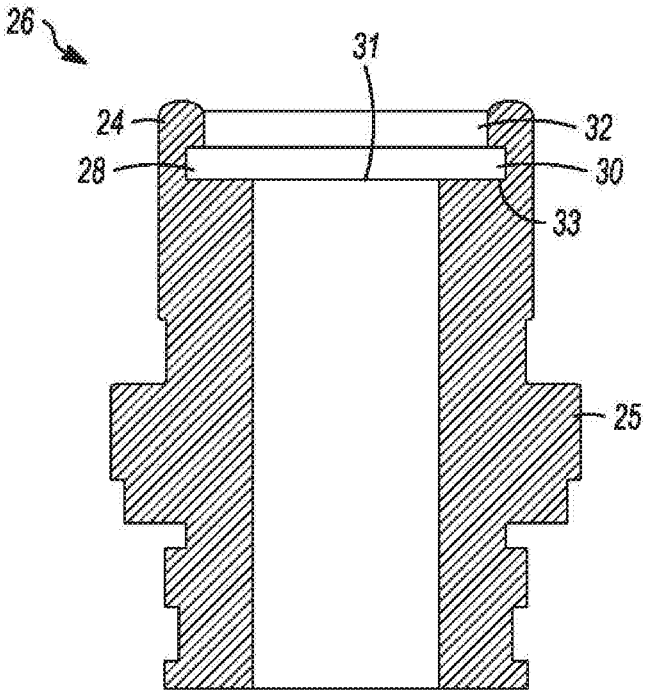
FIG. 7 is a cross-sectional view taken along the 7-7 line of FIG. 6 with a detail of the drain tube of FIG. 1 connected thereto.

The outer end region 22 of the first tubular region 12 can be configured to matingly connect to a suitable connection member in a fluid tight manner. One non-limiting example of a suitable connection member is quick connect member 26 as depicted in FIG. 6. The outer end region 22 can have a suitable lip 28 defined on the outer surface 18 of the drain tube 10 proximate to the first face 24. The lip 28 is configured to engage a corresponding region defined in the quick connect fitting 26 such as detent 30*a*.

The first tubular region 12 can have dimensions suitable to accommodate fluid flow. In certain embodiments, the first tubular region 12 will have an outer diameter that can accommodate an opening defined in an associated oil pan. In certain embodiments, the first tubular region 12 will have an outer diameter $D_o$ between 0.25 inches and 12 inches with an outer diameter $D_o$ between 0.25 inches and 2 inches being possible in some embodiments. In certain embodiments, the outer diameter $D_o$ can be between about 0.5 inches and 1 inch, 0.75 inch to 1.25 inches, 1 inches to 2.0 inches, 1.5 inches to 2.5 inches respectively. The inner diameter of the first tubular region 12 is that sufficient to permit ingress and egress of the target fluid such as crankcase oil as desired or required. In certain embodiments, the inner diameter $D_1$ will be between 0.2 inches and 11 inches with inner diameters $D_1$ between 0.2 inches and 2.0 inches being employed in certain embodiments. In certain embodiments, the inner diameter $D_1$ can be between about 0.5 inches and 1 inch, 0.75 inch to 1.25 inches, 1 inche to 2.0 inches, 1.5 inches to 2.5 inches respectively.

Where desired in certain embodiments, the lip 30 can be configured on a shoulder 32 that projects outward from the first face 24. In certain embodiments, the shoulder 32 can have an outer diameter that has a value less than the outer diameter $D_o$ of the corresponding outer surface 18 of the outer end region 22 proximate thereto. In certain embodiments, the value of the outer diameter of the shoulder 32 can be between 60% and 95% of the value of the outer diameter $D_o$ of the outer surface 18 of the outer end region 22. In certain embodiments, the value of the outer diameter of the shoulder 32 can be between 80% and 90% of the value of the outer diameter $D_o$ of the outer surface 18 of the outer end region 22. The corresponding inner diameter $D_1$ can be the same as the inner diameter of the associated outer end region in certain embodiments.

The drain tube 10 can have a wall thickness suitable T. The thickness T will be one sufficient to provide structural support to the drain tube 10. In certain embodiments, the wall thickness T can be uniform throughout the body of the drain tube 10. It is also contemplated that uniform thickness that term is defined herein can have a variation within a tolerance of any value up to ±10% in certain embodiments. In certain embodiments, it is contemplated that the wall thickness T can vary from region to region in drain tube 10. The drain tube 10 can be constructed from any suitable material. In certain embodiments, the drain tube 10 can be composed of a suitable oil resistant polymeric material. The polymeric material of choice can be a material such as nylon, neoprene of the like. It is also contemplated that the drain tube 10 may be made of a suitable metal material in certain embodiments. In certain embodiments, the wall thickness T can be between about 0.1 to 0.5 inches.

The first tubular region 12 can have any suitable length $F_L$ sufficient to extend into the interior of the associated oil pan when in the use position. The length $F_L$ can vary depending on the volume and configuration of the associated oil pan. In certain embodiments, the first tubular region 12 will have a length $F_L$ measured from the first face 24 to arcuate tubular region that is between 0.5 inch and 10 inches; with lengths between 1 inch and 10 inches being used in certain specific embodiments. In certain embodiments, the length $F_L$ can have a value between 1 inch and 5 inches between 2 inches and 5 inches, between 3 inches and 5 inches.

The first tubular region 12 is contiguously joined into arcuate tubular region 16. Arcuate tubular region 16 can have the cross-sectional inner diameter $D_1$ found in the first tubular region 12. The arcuate tubular region 16 can define an arc of between 45° and 90°.

The second region 14 is continuously joined to the arcuate tubular region 16 at a location opposed to the first tubular region 12 to provide a fluid channel therethrough. The second region 14 includes has an end cap 34 and a longitudinal opening 36 defined in at least a portion of the second region 14 between the arcuate tubular region 16 and the end cap 34.

The longitudinal opening 36 can be an elongated slot 38 in certain embodiments. In the embodiment depicted in FIGS. 1 and 5, the longitudinal opening extends from the end cap 34 and a location generally proximate to the arcuate tubular region 16. The longitudinal opening 36 is oriented at 90° relative to the arcuate region tubular 16 and the X-axis as defined by plane P. In the use position, the longitudinal opening 36, such as elongated slot, is oriented toward the floor of the associated oil pan. The longitudinal opening 36 is typically defined in a central area 39 of the second region 14.

In the embodiment as depicted in the drawing figures, the end cap 34 connected to the distal edge 31 of the second region 14. The end cap 34 can have a suitable geometric contour. In the embodiment as illustrated, the end cap 34 is a flat planar member having a flat outer surface 35 and an opposed interior surface 37. Where desired or required, the opposed interior surface 37 can be contoured to direct fluid flow.

Figure 8:
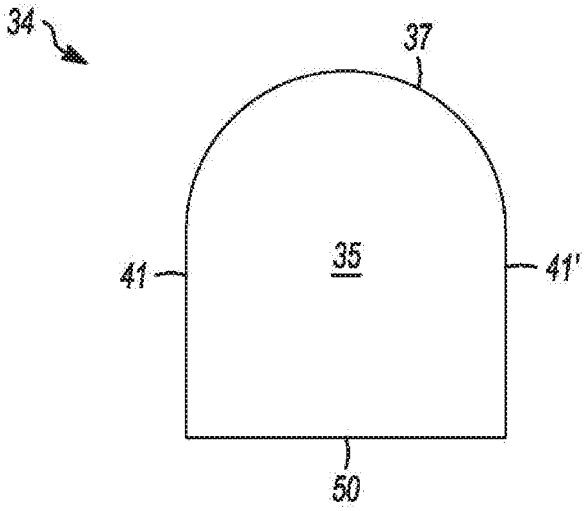
FIG. 8 is a side view of an embodiment of the second region of an embodiment of FIG. 1.
Figure 9:
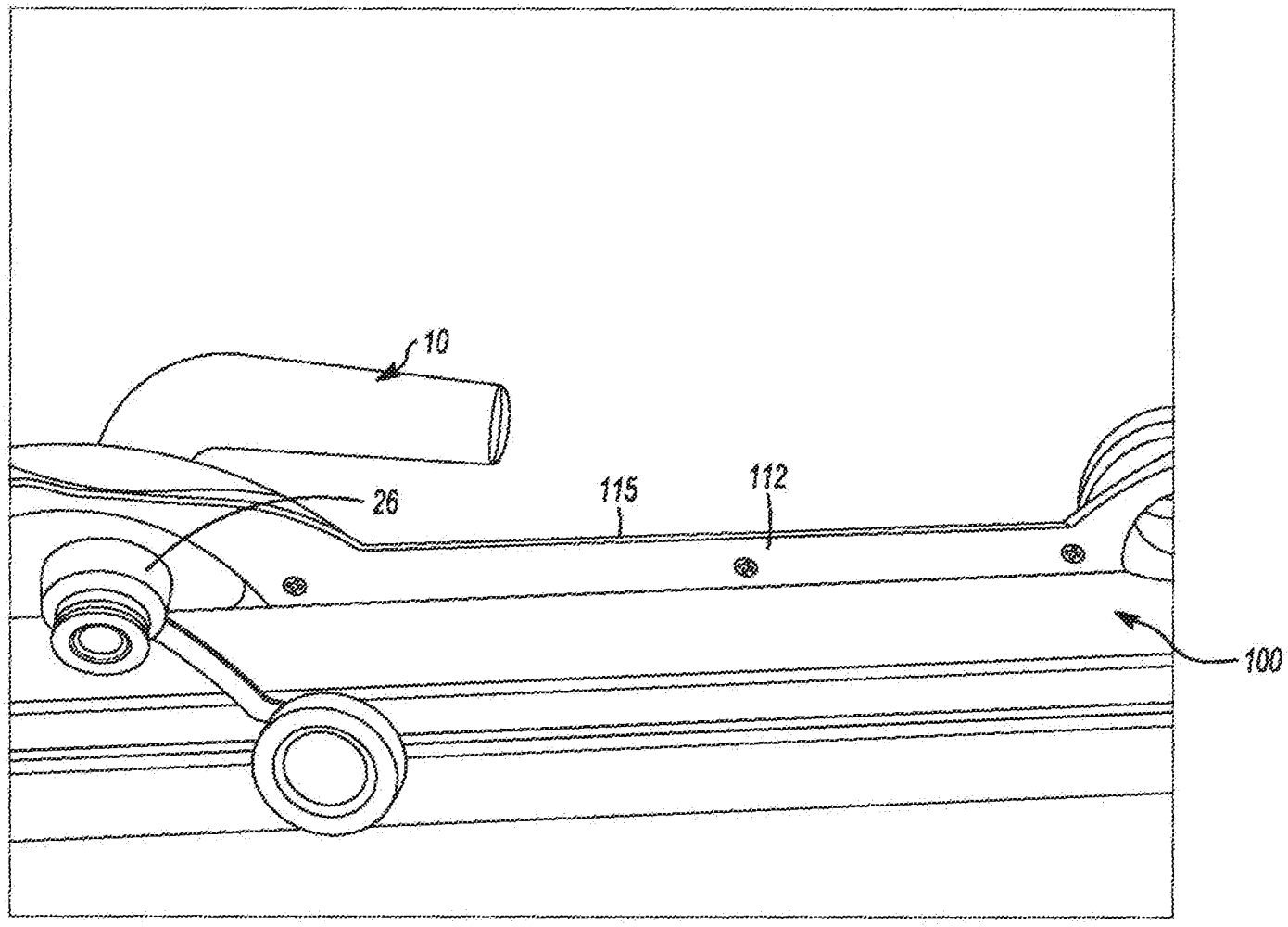
FIG. 9 is perspective view of an embodiment of an oil pan as disclosed herein with an embodiment of the drain plug as disclosed herein in position and a side wall in partial cut-away.
Figure 10:
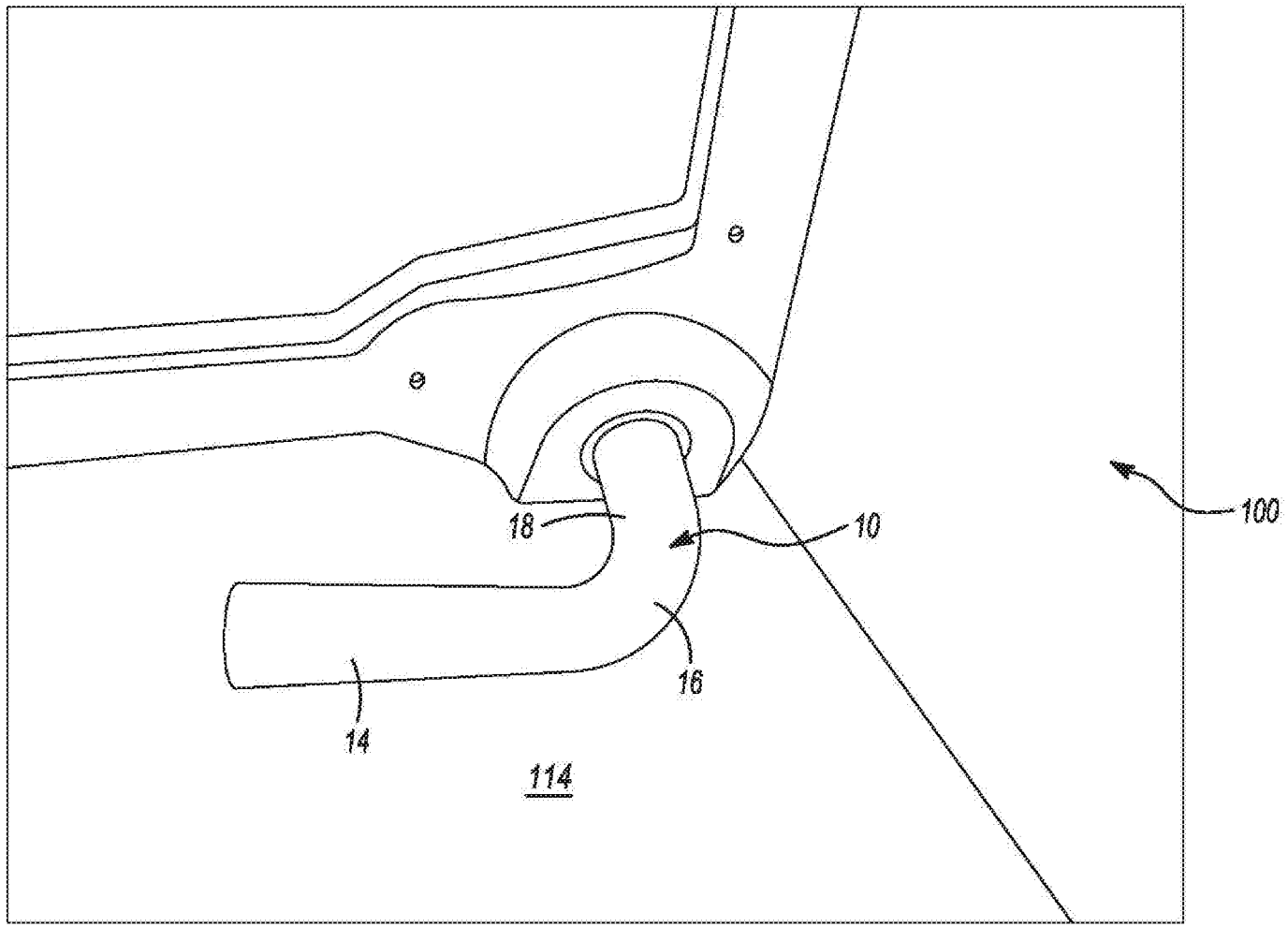
FIG. 10 is detail of the embodiment of FIG. 8.
Figure 11:
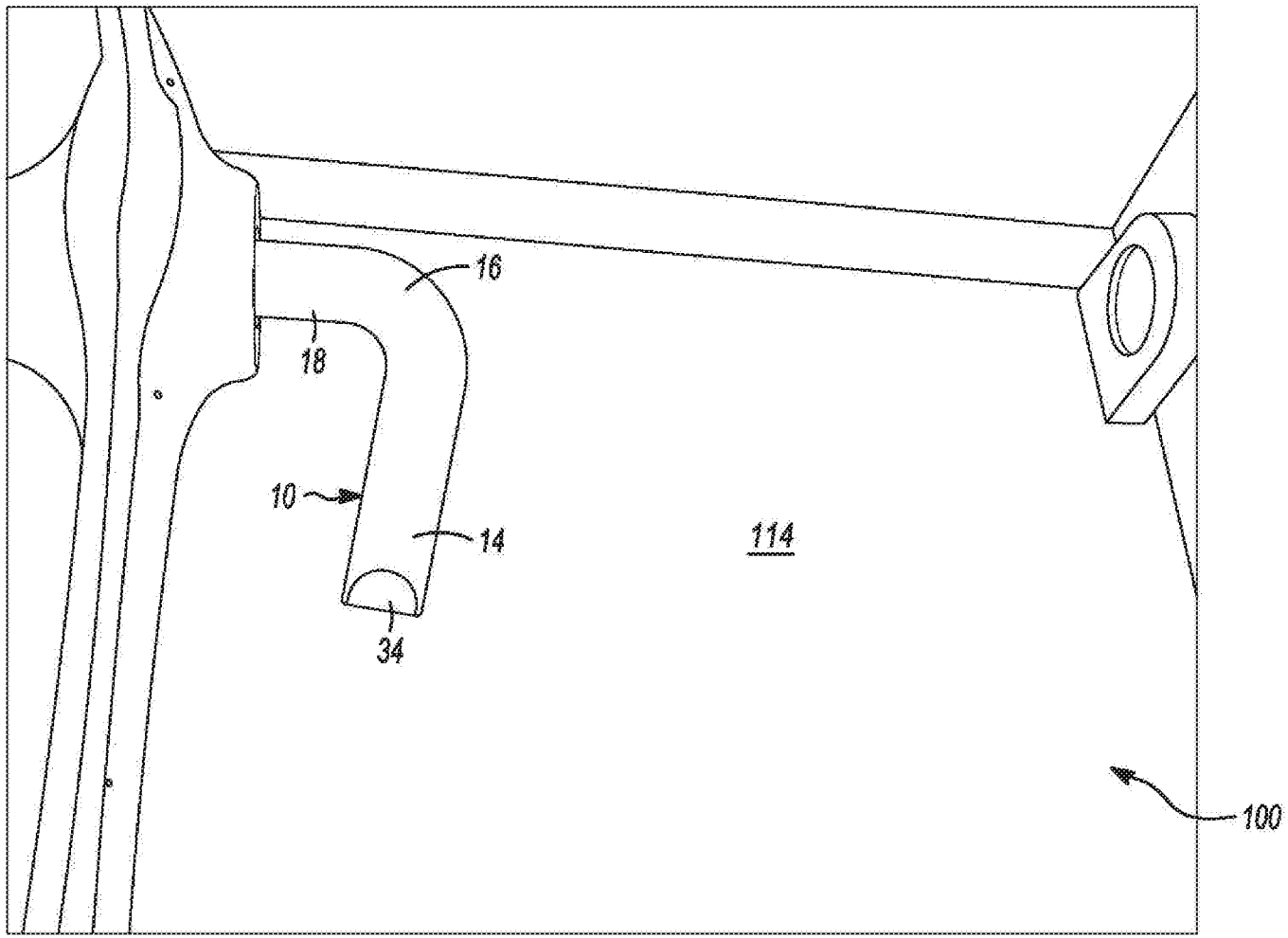
FIG. 11 is a side perspective view of an embodiment of the drain tube as disclosed herein in place in the interior of an oil pan.
Figure 12:
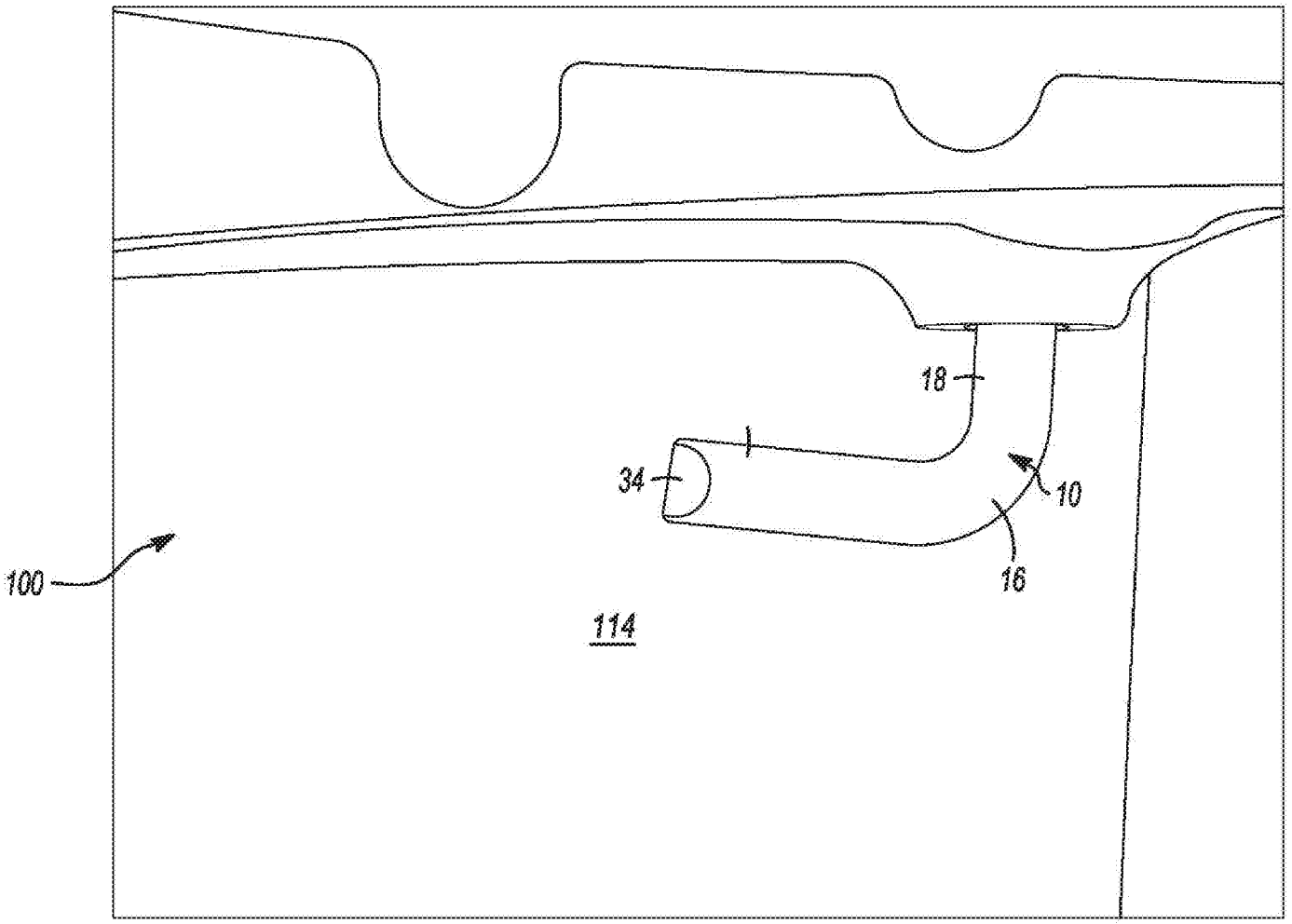
FIG. 12 is a top perspective view of the drain tube of FIG. 10.
Figure 13:
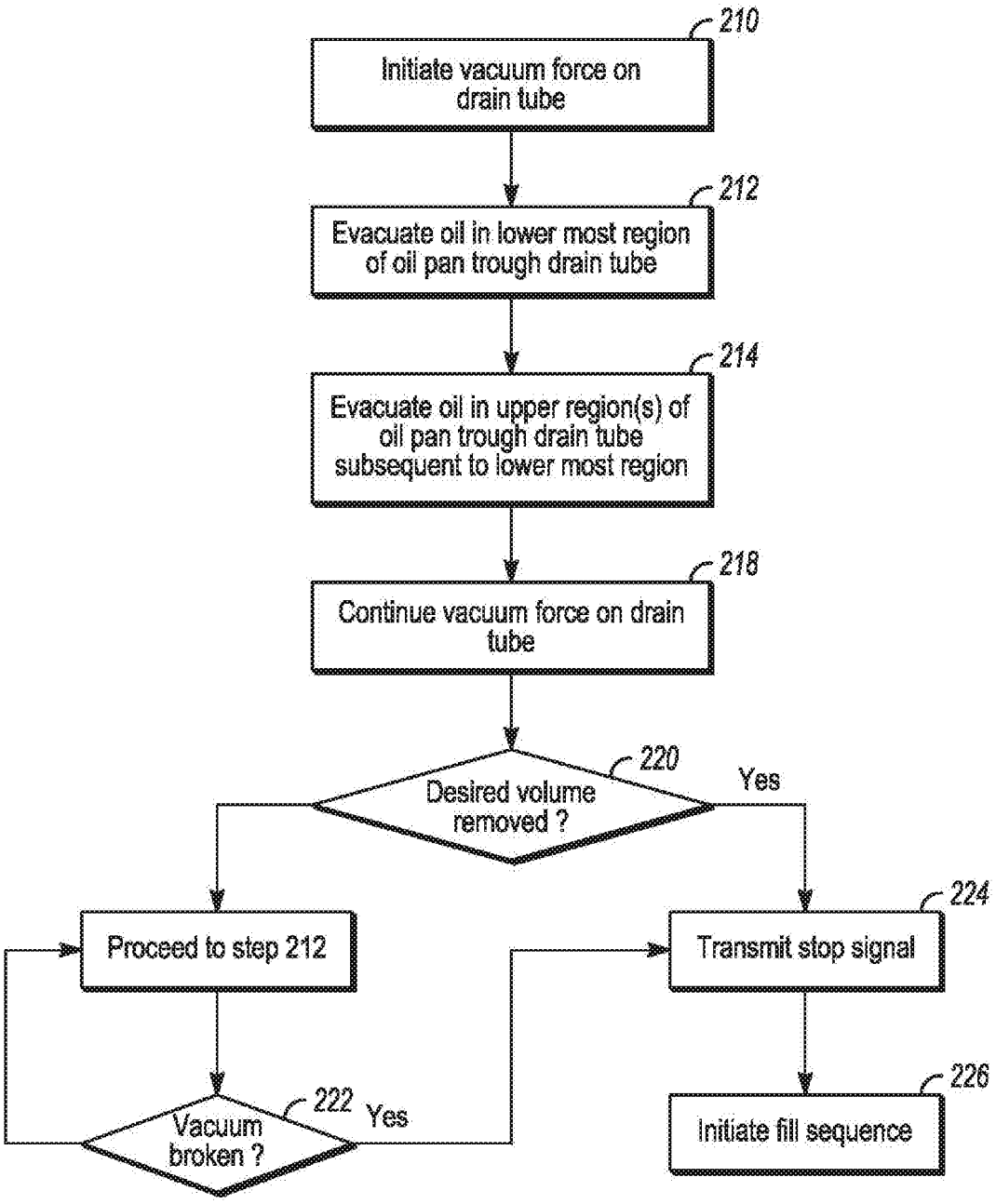
FIG. 13 is a process diagram depicting an embodiment of the oil change process as disclosed herein.

The outer perimeter of the end cap 34 has the cross-sectional contour of the second region 14. As illustrated in FIG. 8, the contour region 37 flanked by two opposed parallel straight edges 41, 41'. The end cap 34 also has a flat planar surface 50 perpendicularly disposed to the two opposed parallel straight edges 41, 41'.

The second region 14 can be configured to direct fluid flow thought the drain tube 10 in one or both directions. In the embodiment depicted in the drawing figures, when in the use position, the second region 14 includes an upper wall member 40 that is elongated and extends along the longitudinal axis in an orientation that is essentially opposed to the longitudinal opening 36. A pair of opposed side walls 42, 44 extend from the upper wall member 40 to define the longitudinal opening 36. As illustrated, the upper wall member 40 has a concave configuration that has an arc of 180° and the opposed side walls 42, 44 are generally elongated planar members. The end cap 34 can be configured as a flat member that conforms to the cross-sectional profile defined by the second region 14. The end cap 34 can be connected to the second region by any suitable manner as by adhesive connection, welding, and the like. In certain embodiments, the end cap can be contiguously molded to the second region 14.

Figure 2:
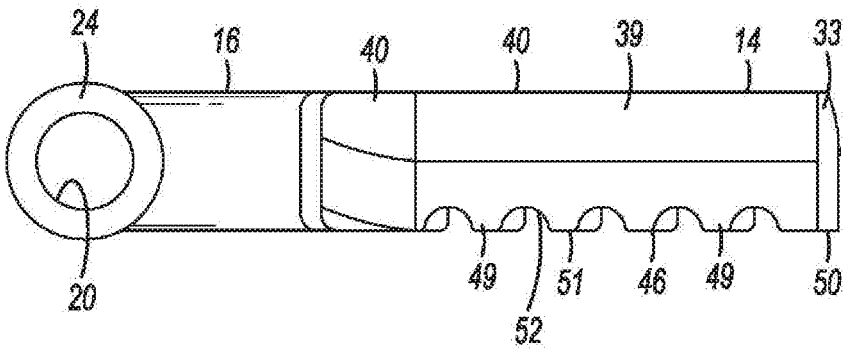
FIG. 2 is side view of the embodiment of FIG. 1.
Figure 3:
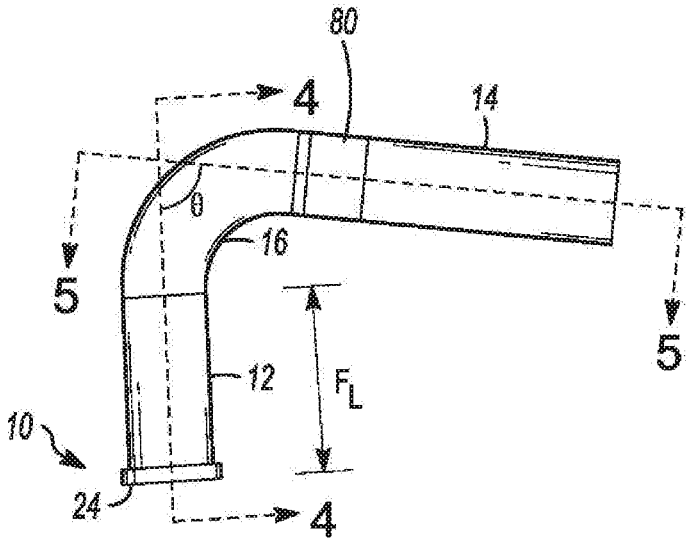
FIG. 3 is a top view of the embodiment of FIG. 1.
Figure 4:
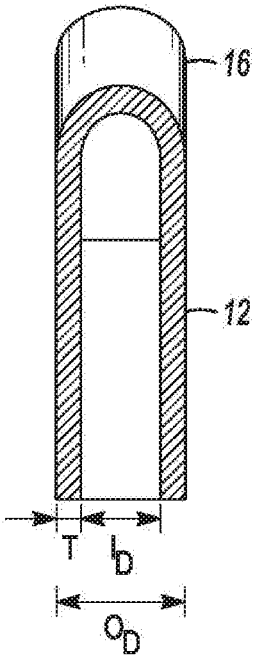
FIG. 4 is a cross-sectional view taken along the 4-4 line of FIG. 1.
Figure 5:
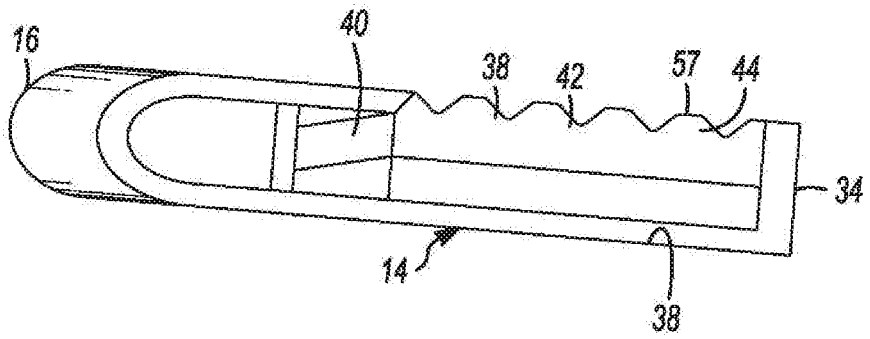
FIG. 5 is a cross sectional view taken along the 5-5 line of FIG. 1.

In the embodiment as illustrated in FIGS. 1, 2 and 5, the opposed side walls 42, 44 each have a respective outer edge 46, 48 that defines the perimeter of the longitudinal opening 36. In certain embodiments, at least a portion of the outer edge 46, 48 and associated lower edge 50 of the end cap 34 is configured to contact the interiorly oriented bottom surface of an oil pan or suitable reservoir. One non-limiting embodiment of such contact is illustrated as surface 114 of the base 110 of oil pan 100.

At least a portion of the outer edges 46, 48 can be configured with projections 49 that elevate the respective outer edges 46, 48 a spaced distance from the interiorly oriented bottom surface 114 of the base of the associated oil pan 100. Projections 49 can extend from the respective outer edges 46, 48 and can each terminate in a distal edge 51. The respective projections 49 can have distal edges 51 that are coplanar with one another. The projections 49 can be located at defined positions on the respective outer edges 46, 48 to define slot(s) 52 through which oil contained in the oil pan 100 can pass. The slot(s) 52 can have any suitable configuration that will accommodate passage of oil therethrough. In the embodiment depicted in FIGS. 1, 2 and 5, at least a portion of the slot(s) 52 are configures as semicircular opening(s).

The number and/or opening area of slot(s) 52 defined by the outer edges 46, 48 of the respective opposed side walls 42, 44 and the projections 49 can vary depending on factors including, but not limited to, the interior volume of the associated drain tube 10, the volume of the associated oil pan 100, the speed at which spent oil is to be removed from the oil pan 100 and/or the nature of the oil to be removed. In the embodiment depicted in FIGS. 1, 2 and 5, the slot(s) 52 defined in the outer edges 46, 48 of the side walls 42, 44 constitute and area between 5% and 50% of the total area defined by the flat planar side walls 42, 44. In certain embodiments, the slot(s) 52 defined in the respective outer edges will constitute about 20% of the total area.

The slot(s) 52 can be disposed in spaced relation along the length of the second region 14 at the longitudinal slot 38. The number of slots(s) 52 can be any number greater than two. In certain embodiments, the number of slots will be a number greater than three with numbers greater than four or five being possible in certain applications. The slots 52 can be disposed on the two opposed side walls 42, 44 in certain embodiments, the slots 52 can be symmetrically disposed to one another on opposed side walls 42, 44 and can be uniformly spaced along the length of the second region 14. As depicted, the second region 14 is configured with five slots 52 per side wall 42, 44 that are uniformly disposed along the length of the respective side wall 42, 44 with the total area of the respective slots 52 being roughly equal to the total area defined by the respective projections 49.

The end cap 34 of the second region 14 of drain tube 10 can be configured with a flat edge 50 that is coplanar to the lower edge(s) 51 of projections 49 defined on the side walls 42, 44 of the second region 14. Thus, in the use position, the lower edge(s) 52 of projections 49 and the flat edge 50 contact the inwardly oriented bottom surface 114 of base 110 to define a plurality of apertures along the side walls 42, 44.

The second region 14 can also include an intermediate transition sleeve 54 interposed between the arcuate tubular region 16 and the central body portion 36*a* of the second region 14. The intermediate transition sleeve 54 can have a central body portion 36*a* having a planar wall portion 58 contiguously connected the arcuate tubular region 16 that terminates at the longitudinal slot 38 at a location proximate to the respective outer edges 46, 48 of the opposed side walls 42, 44. In the embodiment depicted in the drawing figures, the central body portion 56 of the intermediate transition sleeve 54 has an upper wall member 60 that corresponds to the configuration of the arcuate region of upper wall arcuate member 40. The intermediate transition sleeve 54 can also include two side wall members 62, 64 that are configured to correspond to the configuration side walls 42, 44 of the second region 14. The planar wall portion 58 is contiguously joined to the side wall members 62, 64. In certain embodiments, the planar wall portion 58 flares outwardly from a point proximate to a distal edge 59 that will be located at the junction with the second region 14 to the longitudinal slot 38. In certain embodiments, the distal edge 59 will be a straight edge that is coplanar and parallel to the edge 50 of end cap 34.

In certain embodiments, the first tubular region 12 and the second region 14 are oriented in an angular relationship to one another in a first horizontal plane. It is contemplated the longitudinal axis $L_1$ defined by the first tubular region 12 and the longitudinal axis $L_2$ defined by the second region 14 can bisect each other to define an angle θ. The angle θ can be an acute angle less than 90° in some embodiments. In certain embodiments the angle θ can be between 20° and 80°.

The drain tube 10 can define an angle between 0° and 90° in the vertical direction as measured through the central arcuate tubular 1 region 16. In such embodiments, the first tubular region 12 and the second region 14 are typically disposed parallel to a first horizontal plane while the central arcuate tubular region 16 is curved at a suitable angle such that the first tubular region 12 is higher than the second region when the drain tube 10 is in the use position in an associated oil pan. Where the arcuate tubular region 16 curves out of plane, it is contemplated that the angle will be between 0° and 45° in certain embodiments with a rise to run ratio between 1 to 1 and 1 to 5.

The drain tube 10 can be part of a drain tube assembly that includes a suitably configured fitting that is configured to establish a fluid connection with an associated drain plug opening defined in an associated oil pan. Non limiting examples of fittings include suitable drain plug opening fittings 25 such as quick connect fitting 26.

Suitable fittings such as quick connect fitting 26 can be configured with a body 68 defining an interior through bore that is in fluid communication with the corresponding fluid channel defined in the associated drain tube 10. The body 68 of the quick connect fitting 26 also has an exterior surface 70 having a threaded region 72 that is configured to be matingly and threadingly received in a suitably configured opening defined in the wall of an associated oil pan. The quick connect fitting 26 also has an opening 72 adapted to matingly receive a suitably configured region of the first tubular region 12 of the drain tube 10. In the embodiment as illustrated, the suitably configured region of the first tubular region 12 of the drain tube 10 includes lip 30.

The first tubular region 12 of the drain tube 10 can be matingly connected to a suitably configured opening 31 in drain plug opening fitting 25 by any suitable connection mechanism. In the embodiment depicted, the lip 30 defined in the first tubular region of drain tube 10 can be received in an interior detent 33 defined in the body of the drain plug opening fitting 25 opposed to its exteriorly oriented surface.

Connection can be accomplished by one or more of interference fit, mechanical, and/or chemical bonding or the like.

The present disclosure also is directed to an efficient evacuation of a side draining oil pan such oil pan 100 depicted in FIG. 8. The oil pan 100 will have a base 110 and a plurality of walls 112 extending upward from the base 110. When combined with as suitable top member (not shown), the base 110 and walls 112 define an interior chamber configured to collect and contain oil during operation of the associated engine and to collect and retain spent oil prior to evacuation and replacement. The base 110 has an interiorly oriented bottom surface 114. The walls 112 each have an interiorly oriented wall surface 115.

At least one wall 112 of oil pan 100 will be configured with a drain plug region 116 having a drain plug opening 118 defined therein. As manufactured, the drain plug opening 118 can be configured to matingly and sealingly receive a suitable removable drain plug. In configurations, the drain plug opening 118 with an internally threaded region that is adapted to receive a conventional drain plug (not shown). The drain plug opening 118 is located a spaced distance above the interiorly oriented bottom surface 114 of the base 110 in order to maintain the structural integrity of the associated oil pan 100 and/or to take into account the geometry and configuration of the drain plug opening 118.

In conventional oil removal and change operations, once the drain plug is removed from engagement with the drain plug opening 118, the contained oil begins to flow out of the oil pan 100 through the drain plug opening 118 to be collected in a suitable externally located receptacle. Because the drain plug opening 118 is located on the wall 112 of oil pan 100 at a spaced distance above the interiorly oriented bottom surface 114 of base 110, a portion of the spent oil is retained during each oil change operation.

In the oil pan configuration as disclosed herein, oil pan 100 is configured with a drain tube assembly having drain tube 10 connected to fitting 26. Fitting 26 extends through a suitable wall 112 of the oil pan 100 at a spaced distance above the interiorly oriented bottom surface 114 of base 110. First tubular region 12 of drain tube 10 extends inward from the fitting 26 defined to a predetermined location in the interior of the oil pan 100. In the use position, longitudinal slot 38 defined in the second region 14 of drain tube 10 is oriented toward the interiorly oriented bottom surface 114 of base 110.

In the embodiment depicted, the distal ends 51 of projections 49 defined in the second region 14 of the drain tube 10 contact the interiorly oriented bottom surface 114 of base 110. Where the distal edge 50 of end cap 34 and/or the distal edge 59 of planar wall portion 58 is coplanar with the distal ends of projections 49, the respective distal edges 50, 59 also contact the interiorly oriented bottom surface such that the interior channel defined in drain tube 10 is accessed through slot(s) 52.

The drain tube assembly as disclosed herein can be installed in a suitable oil pan such as oil pan 100 in addition to the existing drain plug opening 116 if desired or required. Where desired or required, the drain plug opening fitting 25 of the drain tube assembly can be configured as a quick connect device that can matingly and releasably connect with a suitable fitting associated with an externally located fluid exchange device (not shown) to establish fluid communication between the external device and the interior of the oil pan 100 via drain tube 10. It is also contemplated that the drain tube assembly as disclosed herein can employed as a retrofit in an existing drain plug opening 116. In situations where the drain plug assembly is installed in an existing drain plug opening 116, a suitable fitting such as a quick connect device, can be configured with a suitable region 72 on the exterior surface 70 of the quick connect fitting 26 so as to matingly connect with a suitable internally threaded region (not shown) defined in the drain plug opening 116. The quick connect fitting 26 can be configured to mate with an associated quick connect device that is associated with an externally located fluid exchange device (also not shown) to establish fluid communications between the external device and the interior of the oil pan 100 via drain tube 10 and the associated drain tube assembly.

Without being bound to any theory, it is believed that the drain tube 10 and/or associated drain tube assembly provides a unique fluid channel that can more efficiently and effectively accomplish the evacuation of spent oil from the interior of certain oil pans; particularly in processes where vacuum is being applied during all or part of the evacuation process. In the evacuation process 200 as employed herein, a vacuum force having a value between about 0.25 inches Hg and about 40 inches Hg can be initiated through drain tube 10 associated with oil pan 100 as at reference numeral 210 to draw spent oil proximate to the second region 14 of drain tube 10 into the fluid channel defined therein. Initial portions of the spent oil drawn into the fluid channel is typically the spent oil material proximate inwardly oriented bottom surface 114 and to the plurality of slots 52 located in the lowermost region of the oil pan as at reference numeral 212. The spent oil material proximate to the inwardly oriented bottom surface 114 of the base 110 of the oil pan 100 can include sludge and elevated concentrations of solid particulate material entrained in the spent oil. In certain situations, this portion of spent oil material may be thicker than the spent oil material located at levels closer to the oil surface.

It is believed that, in certain embodiments, the process disclosed herein will preferentially remove spent oil material proximate to the inwardly oriented bottom surface 114 of the base of the oil pan 100 at early stages of the oil evacuation process thereby removing more highly contaminated and possibly thickened, spent oil material that settles to the bottom of the oil pan 100 quickly and efficiently. Without being bound to any theory, it is believed that the vacuum evacuation of the lowermost material is facilitated by the pressure head created by the spent material located in higher regions.

Subsequent removal of spent oil portions that are located closer to the surface of the spent oil material in the oil pan 100 is evacuated subsequent to the initial evacuation step as at reference numeral 214. It is believed that this evacuation process serves to dilute and carry thicker initial material through to the external collection receptacle. It is also believed that the suction action, directed as it is through the plurality of slots 51 draws at least a portion of the fluid from the upper regions into contact with any residue spent oil and particulate contaminants remaining and adhering to the inwardly oriented bottom surface 114 of the oil pan 100 to remove such material. It is also believed that the process and induced fluid flow may eliminate the potential for any clogging or fouling in the fluid channel defined in the drain tube 10 and fluid channels subsequent thereto.

It is also believed that the presence of a plurality of slots 52 located perpendicular to the fluid flow channel defined in the second region 14 of the drain tube 10 assists in achieving a vacuum head effective over a diffuse region in the inwardly oriented bottom surface 114 of the oil pan 100. The spent oil material that is drawn into the fluid channel defined in the second region 14 of the drain tube 10 through the multiple slots 52 induces a turbulent flow in the channel that maintains agitation of any particulate material contained in the spent oil to assist in its removal and transfer away from the oil pan 100 into a suitable external receptacle. It is also believed that the angular orientation of the first tubular region relative to the second region further enhances the evacuation action and aids in the transit spent oil from the oil pan 100.

Where desired or required, spent oil evacuation can continue until the spent oil present in the oil pan 100 is removed and the vacuum being drawn is broken. At this point, vacuum after which generation of the vacuum force can be discontinued as at reference numeral 222. It is also within the purview of this disclosure to remove a portion of the spent oil that is present in the oil pan 100 if desired or required. In such situations, the vacuum force can be discontinued upon the spent oil can be discontinued after the desired volume has been removed as at reference numeral 224.

It is also within the purview of this disclosure that the drain tube 10 and associated drain tube assembly can be used to reintroduce suitable replacement fluid into the oil pan 100 as at reference numeral 226. In such fill operations, fresh or reprocessed material can be introduced into the oil pan 100 under pressure via the drain tube 10 by a suitable pump mechanism. It is also contemplated that all or a portion of the replacement oil can be introduced into the oil pan 100 through a suitable alternate opening.

While the invention has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A drain tube device comprising:

a first tubular region having a tubular wall;

a second region having a wall; and an arcuate tubular region interposed between and connected to the first tubular region and the second region, wherein the first tubular region, the second region and the arcuate region collectively define a central fluid channel, wherein the second region includes an opening defined in the wall of the second region, wherein the second region has an end distal to the arcuate tubular region and wherein the opening in the wall is a longitudinal opening defined in at least a portion of the second region between the arcuate tubular region and the distal end, and wherein the longitudinal opening includes at least two slots contiguous to the longitudinal opening and extending therefrom.

2. The drain tube device of claim 1 wherein the arcuate region is contiguously joined to the first tubular region and the second region such that the first tubular region and the second region form an acute angle in a first plane that is between 45° and 90°.

3. The drain tube of claim 1 wherein the arcuate region further includes a configuration that provides an angle out of the first plane between the first tubular region and the second region that is between zero and 90°.

4. A drain tube device comprising:

a first tubular region having a tubular wall;

a second region having a wall; and an arcuate tubular region interposed between and connected to the first tubular region and the second region, wherein the first tubular region, the second region and the arcuate region collectively define a central fluid channel, wherein the second region includes an opening defined in the wall of the second region, wherein the longitudinal opening is bounded by a pair of longitudinal edges, wherein each longitudinal edge has a plurality of semi-circular openings defined therein.

5. The drain tube of claim 4 wherein the second region has an end distal to the arcuate tubular region and wherein the opening in the wall is a longitudinal opening defined in at least a portion of the second region between the arcuate tubular region and the distal end.

6. The drain tube of claim 5 wherein the longitudinal opening includes at least two slots contiguous to the longitudinal opening and extending therefrom.

7. A drain tube assembly comprising:

a drain tube having a first tubular region, a second region, and an arcuate tubular region interposed between the first tubular region and the second region, wherein the first tubular region, the second region and the arcuate region collectively define a central fluid channel and wherein the second region has an opening defined therein; and a quick connect fitting connected to the first tubular region wherein the quick connect fitting is in fluid connection with the central fluid channel, wherein the second region has an end distal to the arcuate tubular region and includes a longitudinal opening defined in at least a portion of the second region between the arcuate tubular region and the distal end, and wherein the longitudinal opening includes at least two slots contiguous to the longitudinal opening and extending outward therefrom.

8. The drain tube assembly of claim 7 wherein the arcuate region is contiguously joined to the first tubular region and the second region such that the first tubular region and the second region form an acute angle in a first plane that is between 45° and 90° and collectively define a central fluid channel.

9. The drain tube assembly of claim 8 wherein the longitudinal opening includes at least two slots contiguous to the longitudinal opening and extending outward therefrom.

10. The drain tube assembly of claim 7 wherein the second region has an end distal to the arcuate tubular region and includes a longitudinal opening defined in at least a portion of the second region between the arcuate tubular region and the distal end.

11. The drain tube assembly of claim 7 wherein the arcuate region further includes a configuration that provides an angle out of the first plane between the first tubular region and the second region that is between zero and 90°.

12. The drain tube assembly of claim 7 wherein the arcuate region is contiguously joined to the first tubular region and the second region such that the first tubular region and the second region form an acute angle in a first plane that is between 45° and 90° and collectively define a central fluid channel.

13. The drain tube of claim 7 wherein the arcuate region further includes a configuration that provides an angle out of the first plane between the first tubular region and the second region that is between zero and 90°.

14. A drain tube assembly comprising:

a drain tube having a first tubular region, a second region, and an arcuate tubular region interposed between the first tubular region and the second region, wherein the all first tubular region, the second region and the arcuate region collectively define a central fluid channel and wherein the second region has an opening defined therein; and a quick connect fitting connected to the first tubular region wherein the quick connect fitting is in fluid connection with the central fluid channel, wherein the arcuate region is contiguously joined to the first tubular region and the second region such that the first tubular region and the second region form an acute angle in a first plane that is between 45° and 90° and collectively define a central fluid channel, wherein the longitudinal opening is bounded by a pair of longitudinal edges, wherein each longitudinal edge has a plurality of semi-circular openings defined therein.

15. An oil pan assembly comprising:

an oil pan having a base and a plurality of walls contiguously joined to the base, the base and plurality of walls defining an interior chamber, wherein at least one of the plurality of walls has an aperture defined in therein at a location proximate to the base, the base having an interiorly oriented face and the plurality of walls each having an interiorly oriented face and an exteriorly oriented face;

a drain tube projecting through the aperture defined in the wall of the oil pan, the drain tube having a first tubular region having a wall with an outer wall surface and an opposed inner wall surface, wherein the outer wall of the first tubular region is in sealing engagement with the wall of the oil pan at a location proximate to the aperture, an arcuate tubular region contiguously joined to the first tubular region; and an oil delivery region contiguously joined to the arcuate tubular region, the first tubular region, the arcuate tubular region and the oil delivery region cooperatively defining an interior channel, the oil delivery region defined by a wall member and having an aperture defined therein communicating with the interior channel, the aperture oriented toward the interiorly oriented face of the base;

wherein the second region of the drain tube has an end distal to the arcuate tubular region and wherein the opening in the wall of the second region of the drain tube is a longitudinal elongate opening defined in at least a portion of the wall of the second region between the arcuate tubular region and the distal end, wherein the longitudinal opening has a pair of oppose edges, the opposed edges in contact with the inwardly oriented surface of the oil pan, wherein the opposed edges each include at least one slot contiguous to the associated longitudinal opening and extending therefrom, wherein the longitudinal elongate opening has a pair of oppose edges, the opposed edges in contact with the inwardly oriented surface of the oil pan, wherein the opposed edges each include at least one slot contiguous to the associated longitudinal opening and extending therefrom.

16. The oil pan assembly of claim 15 wherein the drain tube assembly further comprising a quick connect adapter connected to the first tubular region of the drain tube at a location exterior to the oil pan wall.

17. The oil pan assembly of claim 15 wherein the arcuate region of the drain tube is contiguously joined to the first tubular region and the second region such that the first tubular region and the second region form an acute angle in a first plane that is between 45° and 90° and wherein the first tubular region projects inward from the associated wall of the oil pan.

18. The oil pan assembly of claim 15 wherein the longitudinal opening is bounded by a pair of longitudinal edges in contact to with the inwardly oriented surface of the oil pan, wherein each longitudinal edge has a plurality of openings defined therein.

19. The oil pan assembly of claim 18 wherein the arcuate region of the drain tube has a configuration that provides an angle out of the first plane between the first tubular region and the second region that is between zero and 90°.

20. A method of removing oil from the oil pan assembly of claim 15 comprising the steps of:

establishing releasable fluid connection between the drain tube and an externally located vacuum evacuation device;

initiating a vacuum force on the drain tube, the vacuum force having a value greater than about 0.25 inches Hg;

drawing an initial portion of fluid contained in the oil pan into the fluid channel in the drain tube, the initial portion of fluid being that located in a lowermost region of the inner chamber of the oil pan, wherein fluid drawn through the slots is agitated as it enters into the inner chamber; and drawing at least one subsequent portion of fluid present in the oil pan into the drain tube subsequent to transit of the initial portion therethrough.

* * * * *